United States Patent [19]

Sakai

[11] 4,363,260

[45] Dec. 14, 1982

[54] AIR CYLINDER

[75] Inventor: Yoshitaka Sakai, Nagoya, Japan

[73] Assignee: Sakai Manufacturing Co., Ltd., Nagoya, Japan

[21] Appl. No.: 234,181

[22] Filed: Feb. 13, 1981

[30] Foreign Application Priority Data

Mar. 19, 1980 [JP] Japan ..... 55-36622[U]

[51] Int. Cl.[3] ..... F15B 15/26

[52] U.S. Cl. ..... 92/13; 92/108

[58] Field of Search ..... 92/8, 142, 143, 108; 91/44; 188/300; 267/64.12

[56] References Cited

U.S. PATENT DOCUMENTS

| | | | |
|---|---|---|---|
| 2,922,497 | 1/1960 | Porter | 188/300 |
| 3,420,148 | 1/1969 | Doerfer | 92/130 R |
| 3,559,776 | 2/1971 | Schultze | 188/300 |
| 3,659,684 | 5/1972 | Porter | 188/300 |
| 4,019,426 | 4/1977 | Wosegien | 92/130 R |

FOREIGN PATENT DOCUMENTS

| | | | |
|---|---|---|---|
| 2920423 | 11/1980 | Fed. Rep. of Germany | 92/108 |
| 70037 | 1/1915 | Switzerland | 92/30 |

*Primary Examiner*—Paul E. Maslousky
*Assistant Examiner*—Ali I. Tangoren
*Attorney, Agent, or Firm*—Jack Posin; Charles A. Blank

[57] ABSTRACT

An air cylinder including a piston adapted to be stopped freely in any position as desired includes an automatic restoring type air cylinder member and a hydraulic cylinder member. The piston is formed with a hydraulic cylinder chamber having fitted therein a hydraulic fixed piston of the hydraulic cylinder member so that the piston can move freely in a cylinder body. An oil chamber defined by the end of the hydraulic fixed piston and the end of the hydraulic cylinder chamber is communicated with an oil tank via an oil passage mounting a check valve that can be opened by pressing means including a pilot piston and other parts.

1 Claim, 2 Drawing Figures

AIR CYLINDER

BACKGROUND OF THE INVENTION

This invention relates to an air cylinder.

Generally an air cylinder of the prior art is of a construction such that it is suitable for use in applications wherein the piston moves over a predetermined range of distances, and the air cylinder of this construction requires the use of a mechanism for increasing the pressure of air and hydraulic fluid to enable the piston to stop at an arbitrarily selected position. The use of the mechanism for increasing the pressure of air and hydraulic fluid has the disadvantages that such mechanism is large in size and control equipment for hydraulic operation is required, thereby increasing production cost.

SUMMARY OF THE INVENTION

This invention has been developed for the purpose of obviating the aforesaid disadvantages of the prior art. Accordingly, the invention has as its object the provision of a novel air cylinder of simple construction, compact size and low cost which is capable of allowing the piston to stop in any arbitrarily selected position, so that the air cylinder can have particular utility in applications wherein speed change of various type of equipment and operation of a clutch are performed.

The outstanding characteristic of the present invention is that there is provided, in an air cylinder, means for freely selecting the position in which the piston of the air cylinder can be stopped within the predetermined range of distances. This feature offers the advantages that the air cylinder operates positively and can be used effectively for changing the speed of various equipment and operating a clutch. An additional advantage is that an overall compact size can be obtained in an air cylinder because the space occupied by the cylinder is not increased even if the distance covered by the movement of the piston increases, thereby avoiding an increase in cost.

DETAILED DESCRIPTION OF THE PREFERRED EMBODIMENT

Figure 1:
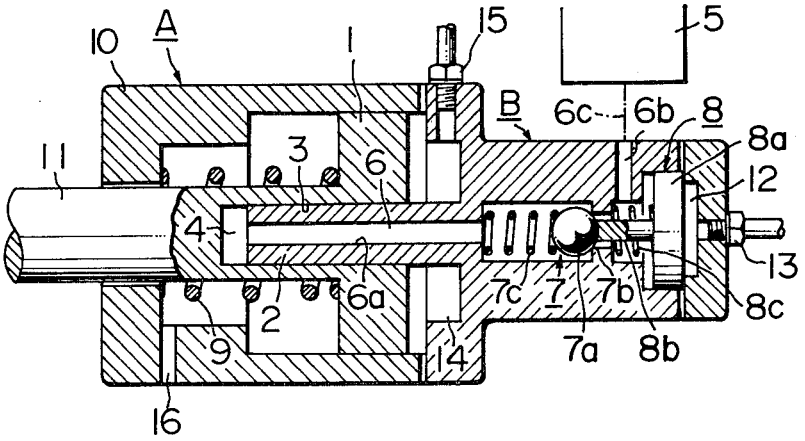
FIGS. 1 and 2 are sectional views of the air cylinder comprising one embodiment of the invention, showing the manner in which the air cylinder operates.

A preferred embodiment of the present invention will now be described by referring to the accompanying drawings. As shown, a piston 1 of an air cylinder member A adapted to be automatically restored to its original position by the biasing force of a return spring 9 is mounted in a cylinder body 10 for free movement back and forth therein. The piston 1 is formed integrally with a piston rod 11 and normally urged by the biasing force of the return spring 9 to return to its original position. A hydraulic fixed piston 2 is formed integrally with a hydraulic cylinder member B and inserted in a hydraulic cylinder chamber 3 formed in the central portion of the piston 1 of the air cylinder member A. A hydraulic chamber 4 is defined between the end of the hydraulic piston 2 and the end of the hydraulic cylinder chamber 3 and has its volume varied in proportion to the distance covered by the movement of the piston 1 of the air cylinder member A. The hydraulic chamber 4 is maintained in communication with an oil tank 5 via an oil passage 6 including a bore **6*a* formed in the hydraulic piston 2, a duct 6*b* formed in the hydraulic cylinder member B and an oil line 6*c*. A check valve 7 is mounted in the oil passage 6 or in the duct 6*b* formed in the hydraulic member B and capable of being forcedly opened as desired by actuating a pilot piston 8*a* and other parts of pressing means 8. In the embodiment shown and described herein, the check valve 7 includes a spherical valve body 7*a* normally urged by the biasing force of a spring 7*c* into engagement with a valve seat 7*b*. However, the invention is not limited to the specific form of the check valve 7 shown and described herein, and other check valve of known construction may be used instead. In the embodiment shown and described herein, the pressing means for forcedly opening the check valve 7 includes the pilot piston 8*a* having a piston rod 8*b* connected to the spherical valve body 7*a*. When necessary, compressed air is introduced through a port 13 into an air chamber 12 to move the piston 8*a* leftwardly in the figures against the biasing force of the return spring 8*c*, to thereby open the check valve 7 by moving the spherical valve member 7*a* away from the valve seat 7*b* against the biasing force of the spring 7*c*. The invention is not limited to this specific form of the pressing means 8 and any known pressing means may be used instead. The air cylinder member A is formed with an air chamber 14 and an air port 15. The numeral 16** designates a ventilating duct.

Figure 2:
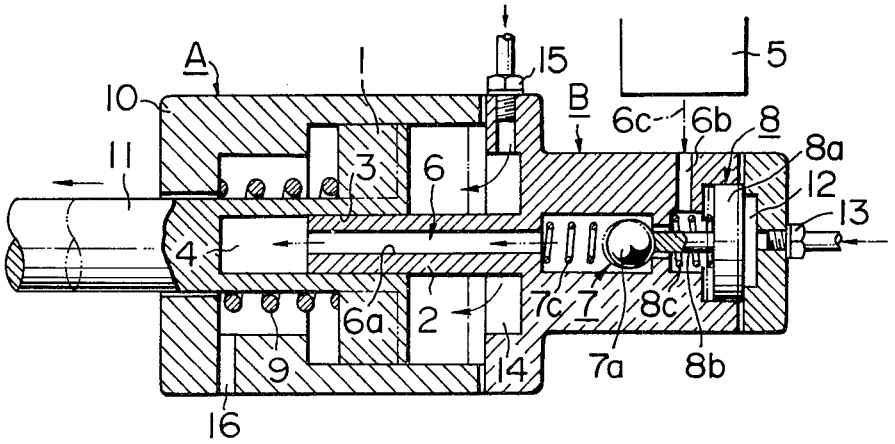

In operation, as compressed air is supplied through the air port 15 to the air chamber 14 of the air cylinder member A, the piston 1 is moved by the compressed air against the biasing force of the return spring 9 and shifts leftwardly from its position shown in FIG. 1 to its position shown in FIG. 2, so that the piston rod 11 can generate various types of equipment. When the piston 1 shifts in this way, the spherical valve body **7*a* is released from engagement with the valve seat 7*b* to open the check valve 7 by the drawing force acting in the hydraulic cylinder chamber 3, to allow the oil in the oil tank 5 to flow into the hydraulic chamber 4 via the oil passage 6 (in the direction of arrows shown in FIG. 2). The supply of compressed air through the air port 15 to the air chamber 14 is interrupted when the piston 1 has moved to the desired position, to thereby interrupt the leftward movement of the piston 1. At this time, the piston 1 is pressed by the return spring 9 to move rightwardly, so that internal pressure is produced in the oil chamber 4 and brings the check valve 7 to the closed position. Thus the piston 1 is held in place by hydraulic pressure in the position in which it has stopped (see FIG. 2). The volume of the oil chamber 4 increases in proportion to the distance covered by the movement of the piston 1, so that the amount of oil drawn is increased to thereby positively hold the piston 1** in place.

When it is desired to move the piston to its original position of rightwardly from its position shown in FIG. 2, compressed air is supplied to the air chamber 12 via the air port 13 of the hydraulic cylinder member B, to move the pilot piston **8*a* leftwardly and open the check valve 7 by releasing the spherical valve body 7*a* from engagement with the valve seat 7*b* against the biasing force of the spring 7*c*. This opens the oil passage 6 and allows the oil in the oil chamber 4 to be returned to the oil tank 5 through the oil passage 6 as the piston 1 is moved rightwardly by the biasing force of the return spring 9. At this time, the volume of the oil chamber 4** is reduced in proportion to the distance covered by the movement of the piston 1 during its return trip.

By adjusting the volumes of air supplied through the air port 15 of the air cylinder member A to the air chamber 14 and through the air port 13 of the hydraulic cylinder member B to the air chamber 12, it is possible to control the movement of the piston 1 so that it can be stopped in any position as desired.

What is claimed is:

1. An air cylinder comprising:

an air cylinder member of an automatic return type including a piston slidably fitted therein and biased by a return spring, said piston being formed in the center of one end thereof with a hydraulic cylinder chamber;

a hydraulic cylinder member including a hydraulic fixed piston snugly fitted in said hydraulic cylinder chamber to allow said piston of said air cylinder of the automatic return type to move freely in sliding movement relative to said hydraulic fixed piston;

an oil chamber defined between the end of said hydraulic fixed piston and the end of said hydraulic cylinder chamber;

a check valve automatically opening in response to movement of said slidably fitted piston in one direction and mounted in a communicating passageway connecting said oil chamber with an oil tank; and pressing means for opening said check valve as desired.

* * * * *